US009364891B2

(12) United States Patent
Takahashi

(10) Patent No.: US 9,364,891 B2
(45) Date of Patent: Jun. 14, 2016

(54) MOLDING DEVICE FOR CONTINUOUS CASTING WITH STIRRING UNIT

(71) Applicant: Kenzo Takahashi, Matsudo (JP)

(72) Inventor: Kenzo Takahashi, Matsudo (JP)

( * ) Notice: Subject to any disclaimer, the term of this patent is extended or adjusted under 35 U.S.C. 154(b) by 0 days.

(21) Appl. No.: 14/391,501

(22) PCT Filed: Dec. 26, 2013

(86) PCT No.: PCT/JP2013/084920

§ 371 (c)(1),
(2) Date: Oct. 9, 2014

(87) PCT Pub. No.: WO2015/019517

PCT Pub. Date: Feb. 12, 2015

(65) Prior Publication Data

US 2015/0283606 A1 Oct. 8, 2015

(30) Foreign Application Priority Data

Aug. 8, 2013 (JP) ..... 2013-165473

(51) Int. Cl.
*B22D 11/115* (2006.01)
*B22D 11/00* (2006.01)
*B22D 11/124* (2006.01)

(52) U.S. Cl.
CPC ..... *B22D 11/115* (2013.01); *B22D 11/001* (2013.01); *B22D 11/003* (2013.01); *B22D 11/004* (2013.01); *B22D 11/124* (2013.01)

(58) Field of Classification Search
CPC ..... B22D 11/00; B22D 11/12; B22D 11/115; B22D 11/122; B22D 11/16; B22D 11/18; B22D 11/186; B22D 11/20; B22D 11/205
See application file for complete search history.

(56) References Cited

U.S. PATENT DOCUMENTS 4,478,273 A 10/1984 Hanås
6,443,221 B1 9/2002 Suzuki et al.

(Continued)

FOREIGN PATENT DOCUMENTS

CN 200991746 Y 12/2007
CN 102990027 A 3/2013

(Continued)

OTHER PUBLICATIONS

Extended European Search Report issued Aug. 20, 2015 in Patent Application No. 13854205.5.

(Continued)

*Primary Examiner* — Kevin P Kerns
*Assistant Examiner* — Steven Ha
(74) *Attorney, Agent, or Firm* — Oblon, McClelland, Maier & Neustadt, L.L.P.

(57) ABSTRACT

A molding device includes a mold that forms a casting by cooling received melt, and a stirring unit that applies a magnetic field to the melt in the mold and allows a current to flow in the melt. The mold forms a vertical casting space that includes an inlet into which the melt flows and an outlet from which a product is taken. A transition plate is disposed at the mold space inlet. The melt can flow into the casting space from a hole in the transition plate. The stirring unit includes a magnetic field unit making lines of magnetic force vertically run into the casting space, and a first electrode at the inlet side and a second electrode at the outlet side that can flow current through the melt in the casting space, and generate an electromagnetic force by making the flowing current cross the lines of magnetic force.

15 Claims, 10 Drawing Sheets

(56) References Cited

U.S. PATENT DOCUMENTS

| | | | |
|---|---|---|---|
| 2007/0169915 | A1 | 7/2007 | Dardik et al. |
| 2013/0192791 | A1 | 8/2013 | Takahashi |
| 2014/0069602 | A1 | 3/2014 | Takahashi |
| 2014/0079561 | A1 | 3/2014 | Takahashi |

FOREIGN PATENT DOCUMENTS

| | | | |
|---|---|---|---|
| EP | 1 033 189 | A2 | 9/2000 |
| EP | 1 033 189 | A3 | 9/2000 |
| EP | 2 594 351 | A1 | 5/2013 |
| JP | 56-154270 | | 11/1981 |
| JP | 6-23498 | A | 2/1994 |
| JP | 8-108257 | A | 4/1996 |
| JP | 9-99344 | | 4/1997 |
| JP | 2003-285142 | A | 10/2003 |
| JP | 2012-35322 | | 2/2012 |
| JP | 2013-103229 | | 5/2013 |
| RU | 2 043 839 | C1 | 9/1995 |
| WO | WO 2013/069314 | A1 | 5/2013 |

OTHER PUBLICATIONS

International Search Report issued Jan. 28, 2014 in corresponding PCT/JP2013/084920 (English translation only).

International Search Report issued Jan. 28, 2014, in PCT/JP2013/084920, filed Dec. 26, 2013 (with English Translation of Category).

U.S. Appl. No. 14/825,893, filed Aug. 13, 2015, Takahashi.

International Preliminary Report on Patentability in PCT Patent Application No. PCT/JP2013/084920 (with English translation).

Written Opinion of the International Searching Authority dated Jan. 28, 2014, in PCT Patent Application No. PCT/JP2013/084920 (with English translation).

MOLDING DEVICE FOR CONTINUOUS CASTING WITH STIRRING UNIT

BACKGROUND OF THE INVENTION

1. Field of the Invention

The present invention relates to a molding device for continuous casting, which is equipped with a stirring unit, of continuous casting equipment that produces a billet, a slab or the like made of non-ferrous metal of a conductor (conductive body), such as Al, Cu, Zn, or an alloy of at least two of them, or an Mg alloy, or other metal.

2. Background Art

In the past, a melt stirring method to be described below has been employed in a mold for continuous casting. That is, for the improvement of the quality of a slab, a billet, or the like, in a process for solidifying the melt, that is, when the melt passes through the mold, a moving magnetic field, which is generated from the outside of the mold by an electromagnetic coil, is applied to the melt present in the mold so that stir occurs in the melt immediately before being solidified. A main object of this stir is to degas the melt and to uniformize the structure. However, since the electromagnetic coil is disposed at the position close to high-temperature melt, not only the cooling of the electromagnetic coil and troublesome maintenance are needed but also large power consumption is naturally needed. In addition, the generation of heat from the electromagnetic coil itself caused by the power consumption cannot be avoided, and this heat has to be removed. Because of this reason, there are various problems in that the device itself cannot but become expensive, and the like.

Patent Document 1: JP 9-99344 A

SUMMARY OF THE INVENTION

The invention has been made to solve the above-mentioned problems, and an object of the invention is to provide a molding device for continuous casting with a stirring unit that suppresses the amount of generated heat, requires easy maintenance, and is easy to use actually, as a molding device that can be made small at a low cost regardless of the size of a product to be obtained.

According to an embodiment of the present invention, there is provided a molding device for continuous casting with a stirring unit, the molding device from which a solid-phase casting can be taken out by the cooling of liquid-phase melt of a conductive material, the molding device including:

a mold that forms a casting by cooling the received melt; and a stirring unit that applies a magnetic field to the melt present in the mold and allows a current to flow in the melt in this state, wherein the mold includes a cylindrical mold body that is vertically provided, a central portion of the mold body forms a vertical casting space that includes an upper inlet into which the melt flows and a lower outlet from which a product is taken out, a transition plate body, which has a ring shape and functions as a transition plate, is disposed at the inlet of the mold space, the melt is allowed to flow into the casting space from a hole that is formed at a central portion of the transition plate body, and the stirring unit includes a magnetic field unit including:

an upper magnet that includes a permanent magnet body provided above a bottom plate of the transition plate body with the bottom plate interposed therebetween and making lines of magnetic force vertically pass through or run into the casting space, and a pair of electrodes that allow the current to flow through the melt when the melt is contained in the casting space, generate an electromagnetic force by making the flowing current cross the lines of magnetic force, and include a first electrode provided at the inlet side and a second electrode provided at the outlet side.

DETAILED DESCRIPTION OF THE INVENTION

For deeper understanding of an embodiment of the invention, an electromagnetic stirring unit, which uses electricity as power, of continuous casting equipment in the related art will be described briefly.

In the related art, a fixed amount of melt M of non-ferrous metal is discharged from a melt receiving box that is called a tundish and is poured into a mold that is provided on the lower side by fixed amount of tapping. Cooling water for cooling the mold is circulated in the mold. Accordingly, high-temperature melt starts to solidify from the outer periphery thereof (the mold side) from the moment that the high-temperature melt comes into contact with the mold. Since the melt, which is positioned at the central portion of the mold, is distant from the wall of the mold that is at a low temperature, the solidification of the melt positioned at the central portion of the mold occurs naturally later than that of the melt positioned at the outer peripheral portion of the mold. For this reason, two kinds of melt, that is, liquid (liquid-phase) melt and a solid (solid-phase) casting are simultaneously present in the mold while coming into contact with each other through an interface. Further, generally, if melt is solidified too rapidly, gas remains in the casting (product) that has been changed into a solid and causes the quality of the product to deteriorate. For this reason, degassing is facilitated by the stirring of the melt that is not yet solidified. The electromagnetic stirring unit, which uses electricity as power, has been used for the stirring in the related art.

However, when such an electromagnetic stirring unit is used, there are various problems as described above.

Figure 1:
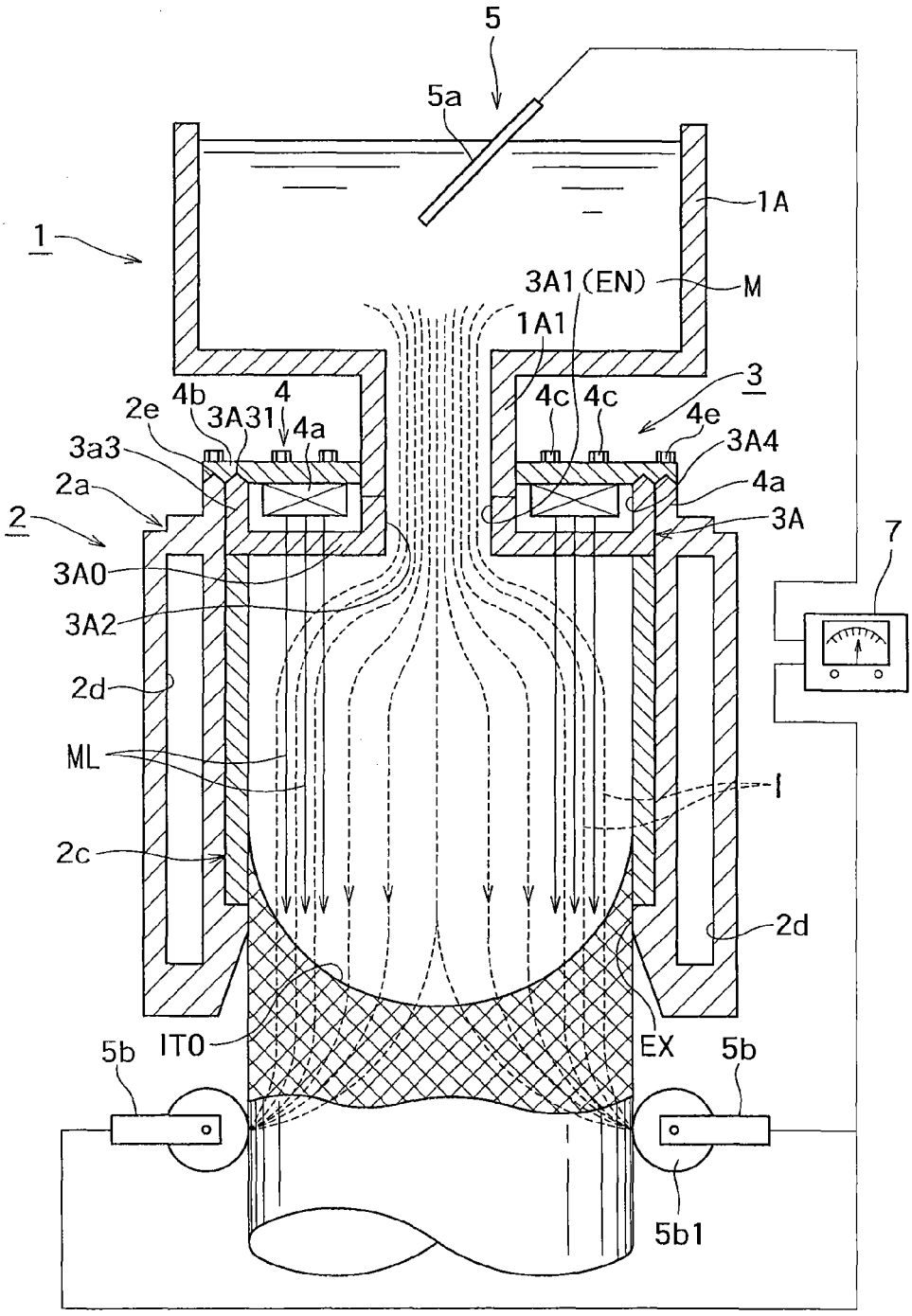
FIG. 1(*a*) is a longitudinal sectional view illustrating the entirety of an embodiment of the invention, and FIG. 1(*b*) is a longitudinal sectional view illustrating only a magnetic field unit as one component of the embodiment.
Figure 1:
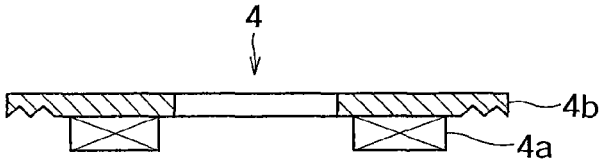

In order to solve these problems, the inventor has previously proposed an invention disclosed in JP 2013-103229 A (prior invention). In this prior invention, current flows in melt in a vertical direction, a magnetic field is applied to the melt in a lateral direction, and the current and the magnetic field are substantially orthogonal to each other, so that the melt M is rotated (stirred) or vibrated by an electromagnetic force according to Fleming's rule. In this prior invention, when the width (diameter or the like) of a product (a billet, a slab, or the like) P is increased, it is possible to cope with the increase of the width of the product by increasing the intensity of a magnetic field of a magnetic field generating unit, accordingly. That is, regardless of whether the product P is a billet having a diameter of several tens centimeters or a slab having a diameter of several tens meters, a permanent magnet having the diameter or having the intensity of a magnetic field according to the diameter may be used. However, the inventor exercises one's ingenuity every day to always produce a more excellent device. As one example, the inventor has a sense of purpose to provide a device that avoids an increase in size, can also be easily manufactured and requires easy maintenance, at a low cost. That is, the inventor proposes a small device for obtaining a high-quality product by stirring or vibrating melt without using a large permanent magnet unit that has the intensity of a magnetic field directly proportional to the increase of the width of the product P even though the width (diameter or the like) of the product P is increased. If each device can be made small in this way, a plurality of devices are disposed in parallel and a plurality of products can be manufactured at a time. Since this challenge is peculiar to the inventor, it is said that other those skilled in the art do not have this task. In order to solve this task, the inventor has performed a lot of experiments on whether melt is actually rotated or vibrated by using a permanent magnet of which the intensity of a magnetic field is lower than the intensity of a magnetic field directly proportional to the diameter. As illustrated in FIG. 1(*a*), one of the experiments is an experiment in which an upper magnet (including permanent magnet) 4*a* is disposed at a position corresponding to an upper end face of a mold 2 and current flows between electrodes 5*a* and 5*b* in this state. This structure is a structure that cannot be employed by those skilled in the art for the rotation or vibration of the melt M. In this case, the direction of a magnetic field and the direction of current are along the same direction (vertical direction). For this reason, those skilled in the art intuitively think that an electromagnetic force according to Fleming's rule is not generated and the melt M is not rotated or vibrated. However, the inventor has performed an experiment on such a structure as one of many experiments. According to this experiment, the melt M present in the mold 2 was rotated and vibrated at a rate, which is considered sufficient, contrary to expectations of most of those skilled in the art having much knowledge about a technique in this technical field. The detailed mechanism thereof is not clear, but, the fact that the melt M rotates and vibrates does not mean anything but the fact that an electromagnetic force is generated according to Fleming's rule, as a result. That is, those skilled in the art thought that the direction of current flowing between the electrodes 5*a* and 5*b* and the directions of the lines ML of magnetic force generated from the upper magnet 4*a* are the same each other and do not cross each other before the experiment is performed. However, it is considered that the direction of current flowing between the electrodes 5*a* and 5*b* and the directions of the lines ML of magnetic force generated from the upper magnet 4*a* actually cross each other and an electromagnetic force according to Fleming's rule is generated. That is, only the inventor having performed the experiments could know that the melt M is rotated and vibrated even in the structure illustrated in FIG. 1(*a*), and those skilled in the art in general not having performed the experiments could never know that the melt M is rotated and vibrated even in the structure illustrated in FIG. 1(*a*). That is, the invention is made on the basis of the results of the experiments that have been uniquely performed by the above-mentioned inventor, and is an invention that is never made by those skilled in the art in general not having performed the experiments. Moreover, since those skilled in the art in general intuitively would think that the melt M was not rotated and vibrated in this structure, those skilled in the art in general would positively exclude this structure. Accordingly, those skilled in the art in general could have never obtained the invention.

An embodiment of the invention, which is formed as described above, will be described below. Meanwhile, in the embodiment of the invention to be described below, a billet, a slab, or the like as a product to be taken out is modified to be provided as a higher-quality product. Further, an electromagnet is not used and a permanent magnet is used, and a small permanent magnet, which is not necessarily directly proportional to the diameter of a product P and of which the intensity of a magnetic field is low, is used as the permanent magnet to be used. Furthermore, a molding device, which manufactures a billet or a slab, is in very high temperature environment. Accordingly, even if a permanent magnet is used, the permanent magnet is heated to high temperature by the heat of the melt M. For this reason, it is also considered that the permanent magnet does not function as a magnet. Therefore, an independent structure for cooling a permanent magnet is newly employed in the embodiment of the invention to prevent the function of the permanent magnet from being shut down by heat even though the permanent magnet is disposed outside a water jacket.

First Embodiment

An embodiment of the invention will be described below with reference to the drawings. Meanwhile, a scale of a drawing is not necessarily the same in the respective drawings.

As understood from FIG. 1A, a device according to an embodiment of the invention includes a melt supply unit 1 that supplies melt M of non-ferrous metal of a conductor (conductive body), such as Al, Cu, Zn, or an alloy of at least two of them, or an Mg alloy, or melt M of other metal; a mold 2 that receives the melt from the melt supply unit 1; and a stirring unit 3 that stirs the melt M present in the mold 2.

(1) Melt Supply Unit 1

The melt supply unit 1 includes a tundish (melt receiving box) 1A that receives melt M from a ladle (not illustrated) or the like. The melt M is stored in the tundish (melt receiving box) 1A, inclusion is removed from the melt, and the melt M is supplied to the mold 2 from a melt supply pipe portion 1A1, which is disposed below the tundish and is narrowed to have the shape of a funnel, at a constant supply rate. The melt supply pipe portion 1A1 is liquid-tightly connected to a central annular wall 3A2 of a transition plate body 3A of the mold 2 as described below.

(2) Mold 2

As also understood from FIG. 1A, the mold 2 is formed as a mold from which a columnar billet as a product P is taken out in this embodiment. An inner portion of the mold 2 forms a casting space 20 in which the melt M is solidified, and an upper portion of the casting space 20 forms an inlet EN into which the melt M flows as a raw material, and a lower portion of the casting space forms an outlet EX for the product P.

The mold 2 includes a substantially cylindrical mold body 2*a* (of which the cross-section has a ring shape), the transition plate body 3A that is disposed inside an upper end portion of the mold body 2*a*, and a cylindrical body 2*c* that is embedded into an inner peripheral surface of the mold body 2*a* and is used to shape the surface of a product.

The mold body 2*a* includes a water jacket 2*d* that is a space formed inside a peripheral wall. The water jacket 2*d* is formed as a space which is formed inside the peripheral wall of the mold body 2*a* and of which the cross-section has an annular shape, and includes an inlet and an outlet (not illustrated) for cooling water. That is, the water jacket allows cooling water to flow into the water jacket 2*d* from the inlet, circulates the cooling water in the water jacket 2*d* to cool the melt M, and then discharges the cooling water from the outlet. The melt M, which is present in the mold body 2*a*, is rapidly cooled by the water jacket 2*d*. Water jackets having well-known various structures may be employed as the water jacket 2*d*. Accordingly, the detailed description of the water jacket will be omitted.

Moreover, a top portion of the mold body 2*a* forms a protruding peripheral portion 2*e* of which the longitudinal section has a chevron shape, and comes into contact with grooves 4*b*1 of the lid body 4*b* with a large contact area by meshing with the grooves 4*b*1 of the lid body 4*b* as described below. Accordingly, thermal conductivity is improved.

Figure 2:
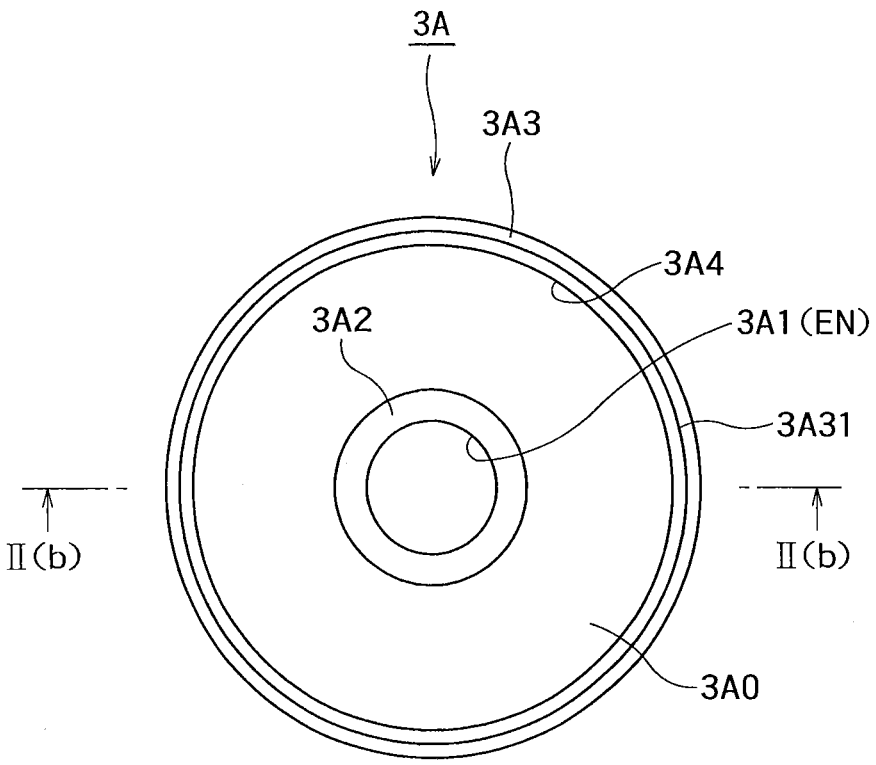
FIG. 2(*a*) is a top view of a transition plate body that is one component of the embodiment, and FIG. 2(*b*) is a sectional view taken along line II(b)-II(b) of FIG. 2(*a*).
Figure 2:
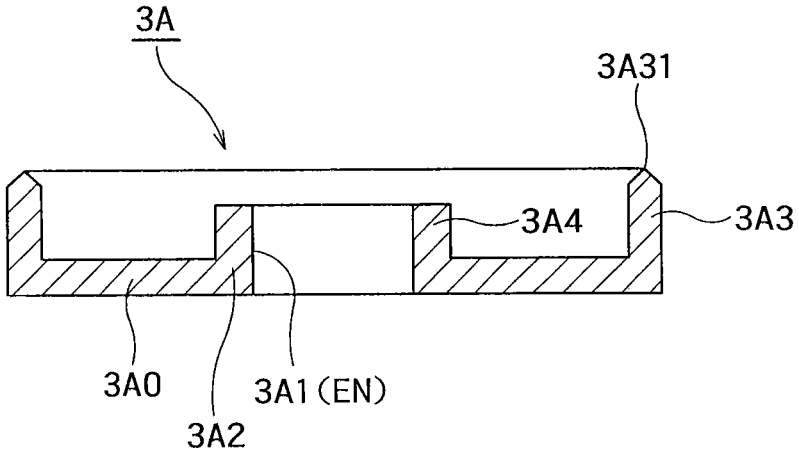

Further, the transition plate body 3A, which is mounted on the mold body 2*a*, is made of a refractory material and includes the inlet EN. FIG. 2(*a*) is a top view of the transition plate body 3A, and FIG. 2(*b*) is a sectional view taken along line II(b)-II(b) of FIG. 2(*a*). As understood from FIGS. 2(*a*) and 2(*b*), the transition plate body 3A is formed so that a central annular wall (central frame-like wall) 3A2 and a peripheral annular wall (peripheral frame-like wall) 3A3 stand at a central portion and a peripheral portion of a bottom plate 3A0 that includes a hole 3A1 (the inlet EN) formed at the center thereof, respectively, and a space surrounded by the central annular wall 3A2 and the peripheral annular wall 3A3 forms an upper magnet receiving space 3A4 that receives an upper magnet 4*a* to be described below. From another perspective, it can be also said that an original large inlet (first inlet) EN0 of the mold body 2*a* is narrowed by the transition plate body 3A to form a small inlet (second inlet) EN and the melt M is allowed to flow in from the small inlet EN.

A top portion of the peripheral annular wall 3A3 also forms a protruding peripheral portion 3A31 of which the section has a chevron shape, and comes into contact with grooves 4*b*1 of the lid body 4*b* with a large contact area by meshing with the grooves 4*b*1 of the lid body 4*b* (FIG. 3(*a*)) as described below. Accordingly, thermal conductivity becomes good. The transition plate body 3A functions as a so-called transition plate (a lid for an upper portion of the mold). That is, the bottom plate 3A0 of the transition plate 2*b* particularly functions as a so-called transition plate.

The cylindrical body 2*c* is embedded into the inner peripheral surface of the mold body 2*a*. The cylindrical body 2*c* is to prevent the high-temperature melt M from coming into direct contact with the mold body 2*a*. Further, the cylindrical body 2*c* is made of carbon, and also has a function of smoothening the skin of the surface of the product P. That is, the cylindrical body 2*c* has both a function of protecting the mold body 2*a* from heat and a function of improving the quality of the skin of the product P.

(3) Stirring Unit 3

The stirring unit 3 stirs and vibrates a melt M which is not yet solidified, by an electromagnetic force (Lorentz force) according to Fleming's left hand rule. The stirring unit 3 includes a magnetic field unit 4 that generates a magnetic field in the melt M present in the mold body 2*a*, and an electrode pair 5 that allows current to flow in the melt M.

(3)-1 Magnetic Field Unit 4

As particularly understood from FIG. 1(*b*), the magnetic field unit 4 includes an upper magnet 4*a* that has the shape of a ring and a lid body 4*b* which has the shape of a ring likewise and on which the upper magnet 4*a* is mounted so as to be suspended. That is, the upper magnet 4*a* is fixed to the lid body 4*b* by bolts 4*c* or the like so as to be suspended, so that the magnetic field unit 4 is formed. As illustrated in FIG. 1(*a*), the magnetic field unit 4 is detachably fixed to the mold 2 by bolts 4*e*. That is, the magnetic field unit 4 is adapted to be easily removed from the mold 2 so that the maintenance or replacement of the magnetic field unit 4 can be performed. The magnetic field unit 4 is not subjected to a constraint of size unlike other magnetic field units built in the water jacket 2*d*. Further, even though the diameter of the product P is increased, the magnetic field unit 4 can be disposed closer to the melt M as compared to a case in which the magnetic field unit is built in the water jacket 2*d*.

Figure 3:
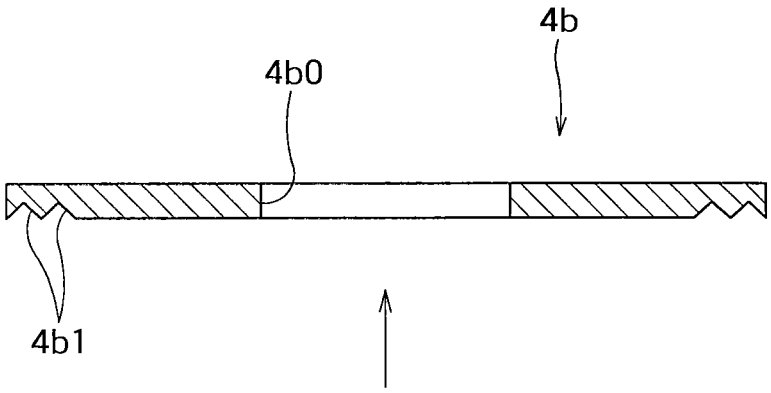
FIG. 3(*a*) is a longitudinal sectional view of a lid body of the transition plate body, and FIG. 3(*b*) is a bottom view of the lid body.
Figure 3:
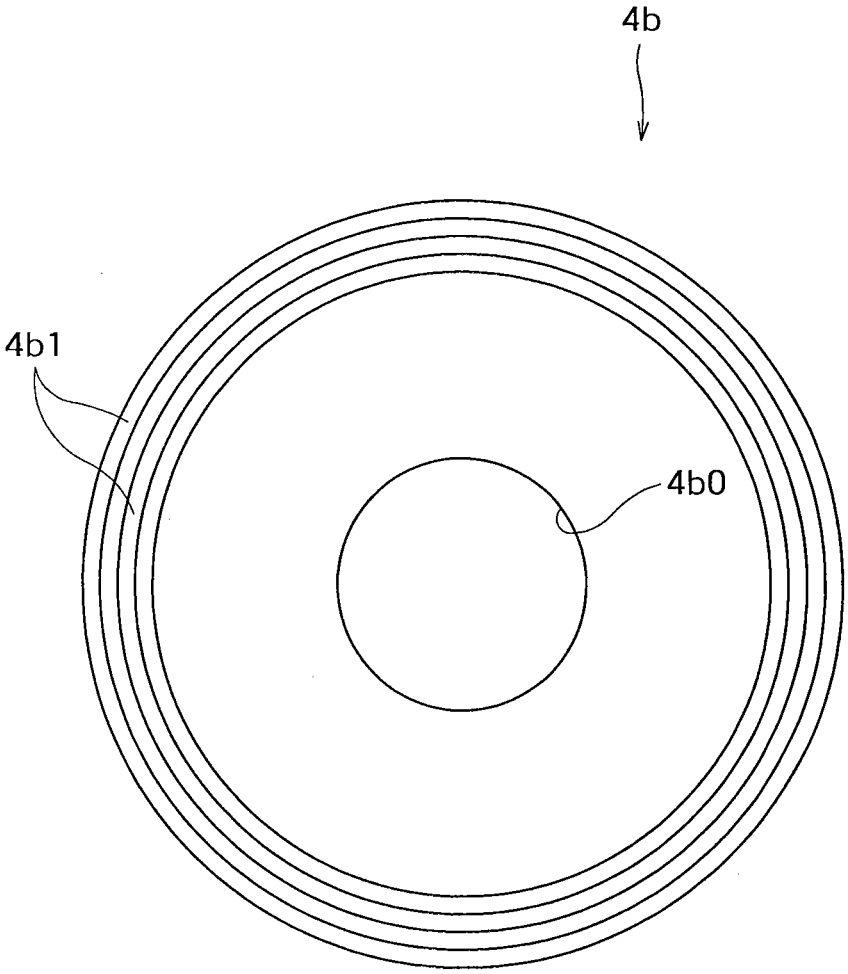

The lid body 4*b* is particularly illustrated in FIGS. 3(*a*) and 3(*b*). FIG. 3(*a*) is a longitudinal sectional view of the lid body 4*b*, and FIG. 3(*b*) is a bottom view of the lid body. As understood from FIGS. 3(*a*) and 3(*b*), the lid body 4*b* includes a hole 4*b*0 at the central portion thereof and a plurality of circumferential grooves 4*b*1 are formed on the lower surface of the lid body 4*b*. These grooves 4*b*1 mesh with the protruding peripheral portion 2*e* of the mold body 2*a* and the protruding peripheral portion 3A31 of the peripheral annular wall 3A3, so that the lid body comes into contact with the mold body 2*a* and the peripheral annular wall 3A3 with a large area. However, the mold body 2*a* and the transition plate body 3A adjacent to the mold body 2*a* are cooled by the water jacket 2*d* of the mold body 2*a*. For this reason, the lid body 4*b*, which meshes with the mold body 2*a* and the transition plate body 3A, and the upper magnet 4*a* (a permanent magnet body 42), which is suspended from the lid body 4*b*, are cooled, so that a function as the magnetic field unit is kept.

Meanwhile, as understood from the above description, the lid body 4*b* and the mold body 2*a* (and the transition plate body 3A) may come into contact with each other with a large contact area, and may employ other structures without being limited to the above-mentioned structure. For example, the pitch of the grooves 4*b*1 of the lid body 4*b* may be made smaller so that protrusions and recesses of the grooves 4*b*1 have finer texture, and the pitch of the protruding peripheral portion 2*e* and the protruding peripheral portion 3A31 meshing with the grooves 4*b*1 may also be made smaller accordingly. Accordingly, a contact area between the grooves and the protruding peripheral portions can be further increased. Further, it is also possible to increase a contact area by using the contact with a tapered surface as a simpler structure instead of the meshing with the protrusions and recesses. Furthermore, a fillet of welding, such as an auxiliary member, may be provided between the lid body 4*b* and the mold body 2*a* and between the lid body 4*b* and the transition plate body 3A to increase a contact area between the lid body and both the mold body and the transition plate body.

Meanwhile, for the cooling of the lid body 4*b*, the lid body 4*b* and the mold body 2*a* have only to mesh with each other and the lid body 4*b* and the transition plate body 3A may not necessarily mesh with each other.

As understood from FIG. 1(*a*), the upper magnet 4*a* applies a magnetic field to the melt M in a vertical direction. FIG. 1(*a*) illustrates a state in which lines ML of magnetic force generated from the upper magnet 4*a* enter the melt M toward the lower side.

Figure 4:
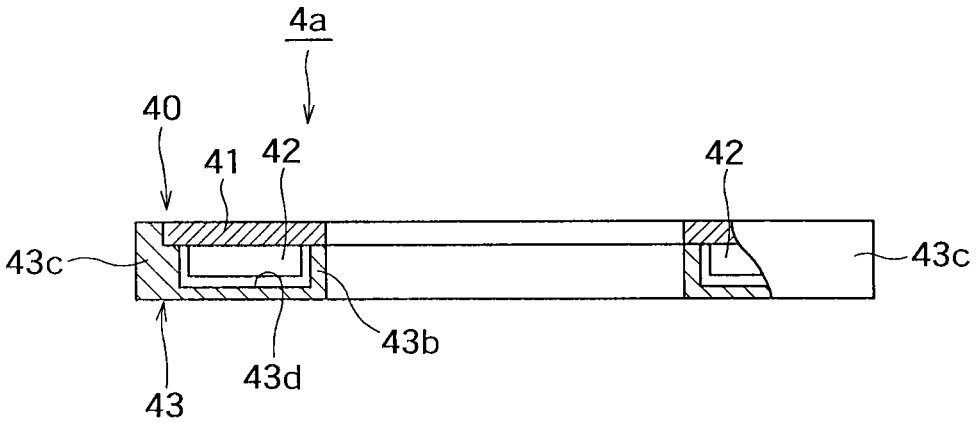
FIG. 4(*a*) is a partial longitudinal sectional side view of an upper magnet, and FIG. 4(*b*) is a top view of a lower cover that is one component of the embodiment.
Figure 4:
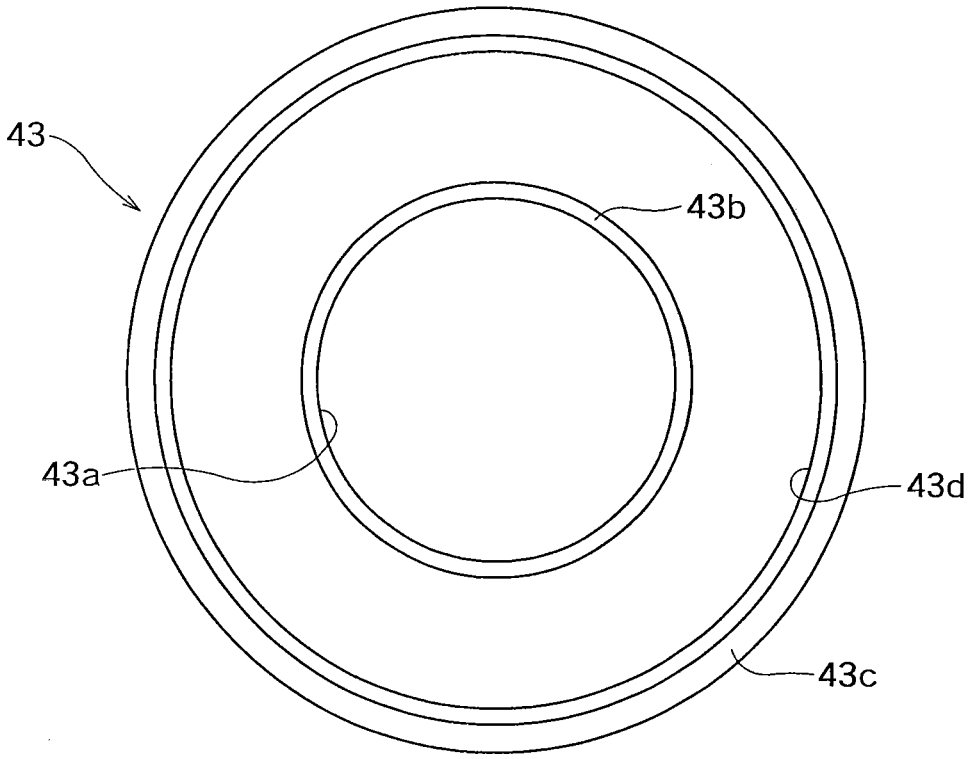

The upper magnet 4*a* is particularly illustrated in FIG. 4(*a*). FIG. 4(*a*) is a longitudinal sectional view of the upper magnet 4*a*. The upper magnet 4*a* includes a magnet body 40 and a cover 43 that covers the magnet body 40 from below. The magnet body 40 includes a yoke body 41 as a base that is a ring-shaped flat plate, and a permanent magnet body 42 that is mounted on the lower surface of the yoke body so as to be suspended.

As understood from FIG. 4(*b*) that is a top view, the cover 43 has the shape of a ring including a hole 43*a* at the center thereof, and is formed so that an inner periphery-side annular wall 43*b* and an outer periphery-side annular wall 43*c* stand on an inner peripheral side and an outer peripheral side thereof, respectively, and a ring-shaped space surrounded by the inner periphery-side annular wall 43*b* and the outer periphery-side annular wall 43*c* forms a permanent magnet receiving chamber 43*d*. The permanent magnet body 42 is received in the permanent magnet receiving chamber 43*d* with a gap.

Figure 5:
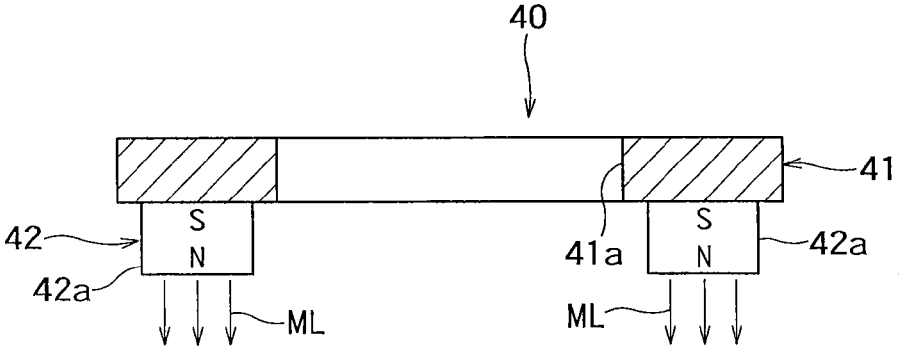
FIG. 5(*a*) is a longitudinal sectional view of a magnet body (a yoke body and a permanent magnet body) that is one component of the upper magnet, and FIG. 5(*b*) is a bottom view of the magnet body.
Figure 5:
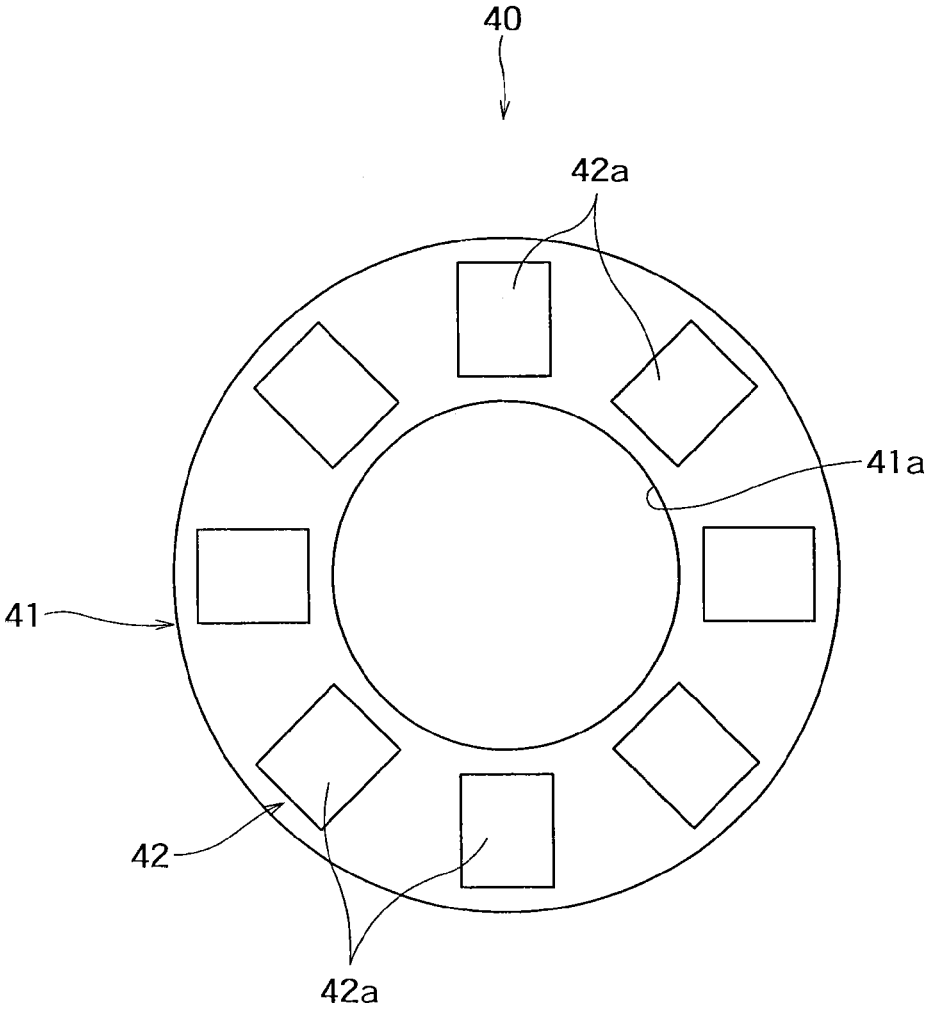

The magnet body 40, which is covered with the cover 43 from below, is illustrated in FIGS. 5(*a*) and 5(*b*). FIG. 5(*a*) is a longitudinal sectional side view and FIG. 5(*b*) is a bottom view. As particularly understood from FIG. 5(*a*), the yoke body 41 has the shape of a ring including a hole 41*a* at the central portion thereof. The permanent magnet body 42 is fixed to the lower surface of the ring-shaped yoke body 41 so as to be suspended. The permanent magnet body 42 is formed as an assembly of a plurality of rectangular magnets 42*a*, 42*a*, . . . . As particularly understood from FIG. 5(*a*), a lower portion of each magnet 42*a* is magnetized to a first pole (here, N pole) and an upper portion of each magnet 42*a* is magnetized to a second pole (here, S pole). Accordingly, the lines ML of magnetic force go downward. Meanwhile, the magnetization directions of the magnets may be opposite to the above-mentioned magnetization directions. These magnets 42*a*, 42*a*, . . . are integrally fixed to the yoke body 41, so that the magnet body 40 is formed. The magnet body 40 is placed on and fixed to the cover 43 from above as illustrated in FIG. 4(*a*), so that the upper magnet 4*a* is formed. The upper magnet 4*a*, which is formed in this way, is received in the upper magnet receiving space 3A4 of FIG. 1(*a*) with a gap as described above.

Figure 6:
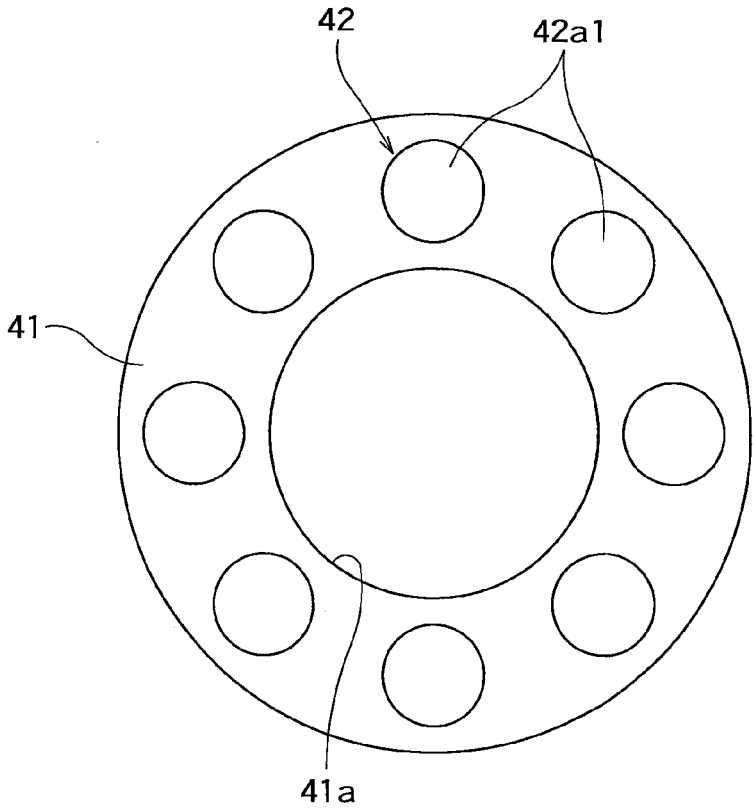
FIG. 6 is a bottom view of a magnet body of another embodiment.
Figure 7:
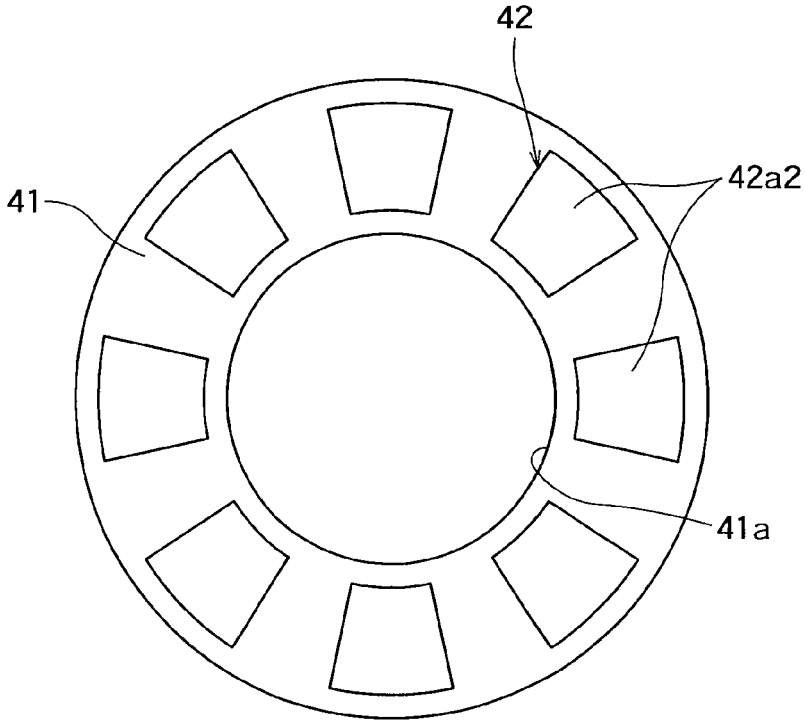
FIG. 7 is a bottom view of a magnet body of still another embodiment.
Figure 8:
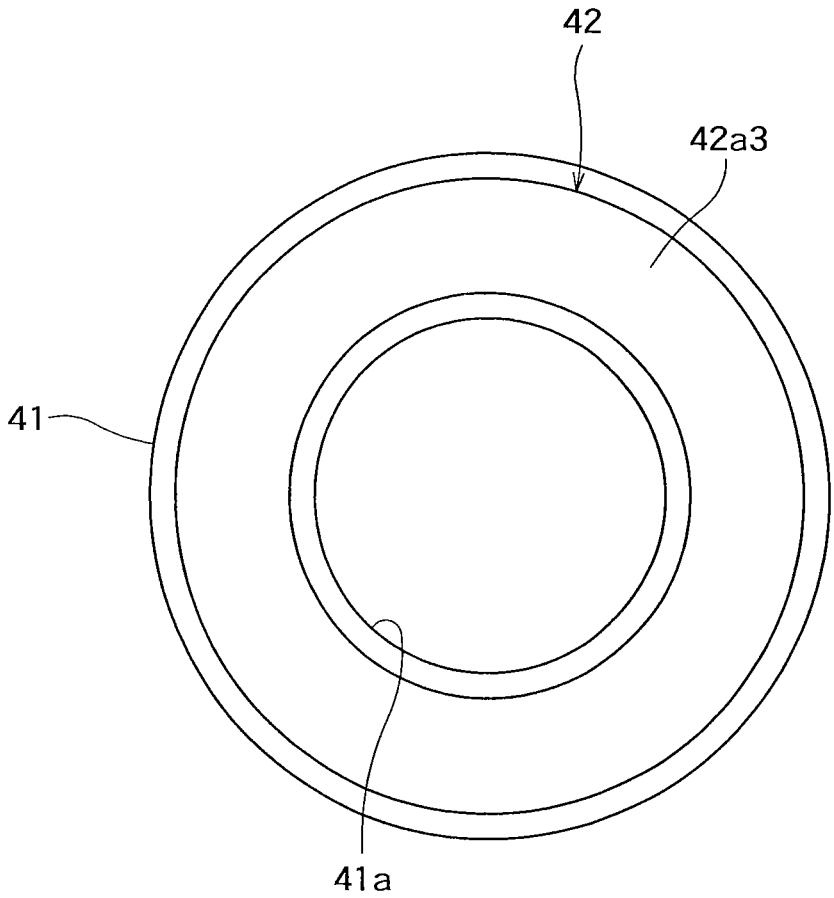
FIG. 8 is a bottom view of a magnet body of yet another embodiment.

Meanwhile, various magnet bodies may be used as the permanent magnet body 42 other than the permanent magnet body illustrated in FIGS. 5(*a*) and 5(*b*). That is, any magnet body, which generates lines ML of magnetic force in the vertical direction in FIG. 1(*a*), may be used. Other distinct examples of the magnet body are illustrated in FIGS. 6 to 8, respectively. A plurality of columnar magnets 42*a*1 illustrated in FIG. 6, or a plurality of pillar-shaped magnets 42*a*2 having a substantially fan-shaped cross-section, that is, having a fan shape of which the base end portion is cut off as illustrated in FIG. 7 may be used instead of the plurality of rectangular magnets 42*a* illustrated in FIGS. 5(*a*) and 5(*b*). Further, a permanent magnet body 42, which is formed of one annular magnet 42*a*3 as illustrated in FIG. 8, may be used instead of the permanent magnet body 42 that is formed of the plurality of magnets 42*a* as illustrated in FIGS. 5(*a*) and 5(*b*).

Meanwhile, in FIG. 1(*a*), an air pipe (not illustrated) for cooling the magnet body 40 (upper magnet 4*a*) with air may be provided as necessary.

(3)-2 Electrode Pair 5

Next, the electrode pair 5 of the stirring unit 3 will be described. As understood from FIG. 1(*a*), the electrode pair 5 includes a rod-shaped electrode 5*a* and roller-shaped electrodes 5*b*.

One end of the rod-shaped electrode 5*a* is immersed in the melt M present in the tundish (melt receiving box) 1A. Rollers 5*b*1 of the roller-shaped electrodes 5*b* are provided so as to come into press contact with the surface of a product (billet) P, which has been taken out, and so as to be electrically conducted to the product. Accordingly, these electrodes 5*a* and 5*b* are electrically conducted to each other through the melt M and the product (billet) P. Accordingly, current flows between these electrodes 5*a* and 5*b* through the melt M and the product (billet) P as described in detail below. The plurality of roller-shaped electrodes 5*b* have been provided in this embodiment, but the number of the roller-shaped electrodes 5*b* may be one or three or more. When the plurality of roller-shaped electrodes 5*b* are provided, the roller-shaped electrodes 5*b* may be radially disposed so as to surround the outer periphery of the product (billet) P as illustrated in FIG. 1(*a*).

In more detail, in FIG. 1(*a*), the roller-shaped electrodes 5*b* are provided in a system of the device so that the positions of the roller-shaped electrodes 5*b* are fixed. That is, the roller-shaped electrodes 5*b* are provided with the rotatable conductive rollers 5*b*1 at the tips thereof. The rollers 5*b*1 are provided so as to come into press contact with the outer surface of a product P as a casting (a billet or a slab) that is extruded in a solid-phase state. Accordingly, the rollers 5*b*1 are rotated by the product P as the product P extends downward. That is, when the product P is extruded downward, the product P extends downward in FIG. 1(*a*) while the product P keeps the contact with rollers 5*b*1 and rotates the rollers 5*b*1. Moreover, these electrodes 5*a* and 5*b* are connected to a power control panel 7, and are adjusted so that a voltage, current, frequency, and the like can be adjusted. That is, direct current or low-frequency alternating current, for example, alternating current in the range of 1 to 5 Hz can be selected as flowing current by, for example, the power control panel 7.

Accordingly, for example, when a DC voltage is applied between the pair of electrodes 5*a* and 5*b* from the power control panel 7, direct current flows between the pair of electrodes 5*a* and 5*b* through the melt M and the product P. The amount of current flowing between the pair of electrodes 5*a* and 5*b* can be controlled as described above. Accordingly, it is possible to select current, which allows liquid-phase melt M to be most efficiently stirred, by a relationship with the lines ML of magnetic force. Further, for example, when a low-frequency AC voltage in the range of about 1 to 5 Hz is applied between the pair of electrodes 5*a* and 5*b* from the power control panel 7, the melt M is not rotated in one direction but vibrated. Inclusion contained in the melt M is removed by this vibration.

Next, the operation of the device having the above-mentioned structure will be described.

In FIG. 1(*a*), a fixed amount of melt M, which is discharged from the melt supply pipe portion 1A1 of the tundish (melt receiving box) 1A, flows into an upper portion of the mold 2 from the central annular wall 3A2 (inlet EN) of the transition plate body 3A. Since the mold 2 is cooled by the circulation of water in the water jacket 2*d*, the melt M having flowed into the mold 2 is rapidly cooled and solidified. Here, the melt M present in the mold 2 has a two-phase structure in which an upper portion of the melt is liquid (liquid-phase) and a lower portion of the melt is solid (solid-phase) and the upper and lower portions of the melt come into contact with each other at an interface ITO. The melt M is casted in a columnar shape (or the shape of a square post) corresponding to the shape of the mold while passing through the mold 2, so that a billet (or a slab) as a product P is continuously formed.

The melt M is solidified in this way. However, before being solidified, the melt M is rotated by making direct current flow between the electrodes 5*a* and 5*b* under the presence of a magnetic field generated by the upper magnet 4*a* and is vibrated by making low-frequency alternating current flow between the electrodes under the presence of a magnetic field generated by the upper magnet. This has been briefly described above, but this is also confirmed by the experiments of the inventor. The melt M forms a product by solidification after the quality of the melt is improved in this way.

The melt M is rotated and vibrated as described above, the mechanism thereof is considered as follows: the rotation and vibration of the melt M is not different from the generation of an electromagnetic force according to Fleming's left hand rule when the lines ML of magnetic force generated from the upper magnet 4*a* cross current flowing between the electrodes 5*a* and 5*b*. It is considered that the lines ML of magnetic force generated from the upper magnet 4*a* are formed as shown in FIG. 1(*a*). That is, it is not considered that the lines of magnetic force pass through other paths except for paths shown in FIG. 1(*a*). Further, it is considered that current I flowing between the electrodes 5*a* and 5*b* flows through not only paths that connect both electrodes 5*a* and 5*b* at the nearest points but also through a lot of paths as illustrated in FIG. 1(*a*). The reason for this is considered that the current I and the lines ML of magnetic force cross each other since the melt M is actually rotated and vibrated as described above. Accordingly, the current I and the lines ML of magnetic force cross each other, so that an electromagnetic force according to Fleming's left hand rule is generated and the melt M is rotated or vibrated.

In the embodiment of the invention, as described above, a magnetic field is applied to the melt M, which is not yet solidified, from the upper magnet 4*a* that is disposed on the end face portion of the mold 2. For this reason, even though the width of the mold 2, that is, the diameter of the product P to be obtained is large, that is, several meters like a slab, it is possible to apply a magnetic field to the melt regardless of the width of the mold, so that an electromagnetic force according to Fleming's left hand rule is obtained. Accordingly, it is possible to reliably rotate and vibrate the melt M. That is, even though the product P to be obtained is small like a billet or is large like a slab, a magnetic field unit generating a particularly large and strong magnetic field does not need to be used as the upper magnet 4*a* regardless of the size of the product. In contrast, as described above, a magnetic field unit that applies a magnetic field having intensity according to the diameter of a product P to be obtained should be used in a device in the related art that laterally applies a magnetic field, as explained above. The magnetic field unit, which applies a magnetic field having such high intensity, actually has a very large size. For this reason, it may be difficult to actually use a magnetic field unit that applies a very large magnetic field or a large magnetic field unit. Further, since the size of the device becomes very large if the magnetic field unit is actually used, it may also be difficult to realize a device that produces a plurality of billets or slabs.

Meanwhile, the electrodes, which are provided with the rollers 5*b*1 at the tips thereof, are used as the lower electrodes 5*b* in the above-mentioned embodiment. However, the lower electrodes do not need to be provided with the rollers 5*b*1. Even though the product P is continuously extruded, electrical conduction between the product P and the electrode 5*b* has only to be kept and various structures may be employed. For example, elastic members having a predetermined length may be used as the electrodes 5*b*. In FIG. 1(*a*), for example, elastic members may be used, the tips of the elastic members may come into press contact with the casting P by the restoring forces of the elastic members, and the casting P may be allowed to extend downward in this state.

Second Embodiment

Figure 9:
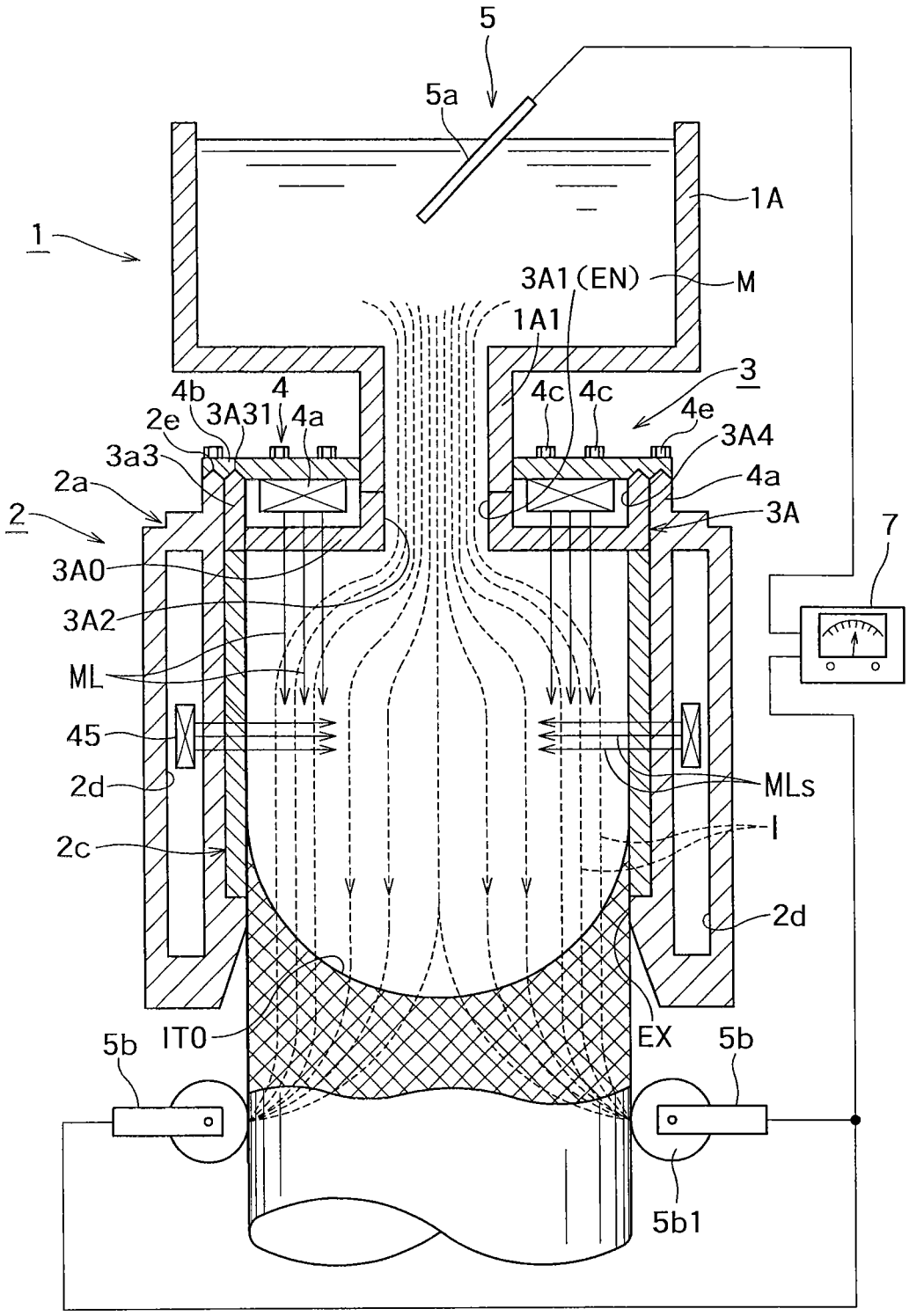
FIG. 9 is a longitudinal sectional view illustrating the entirety of another embodiment of the invention.
Figure 10:
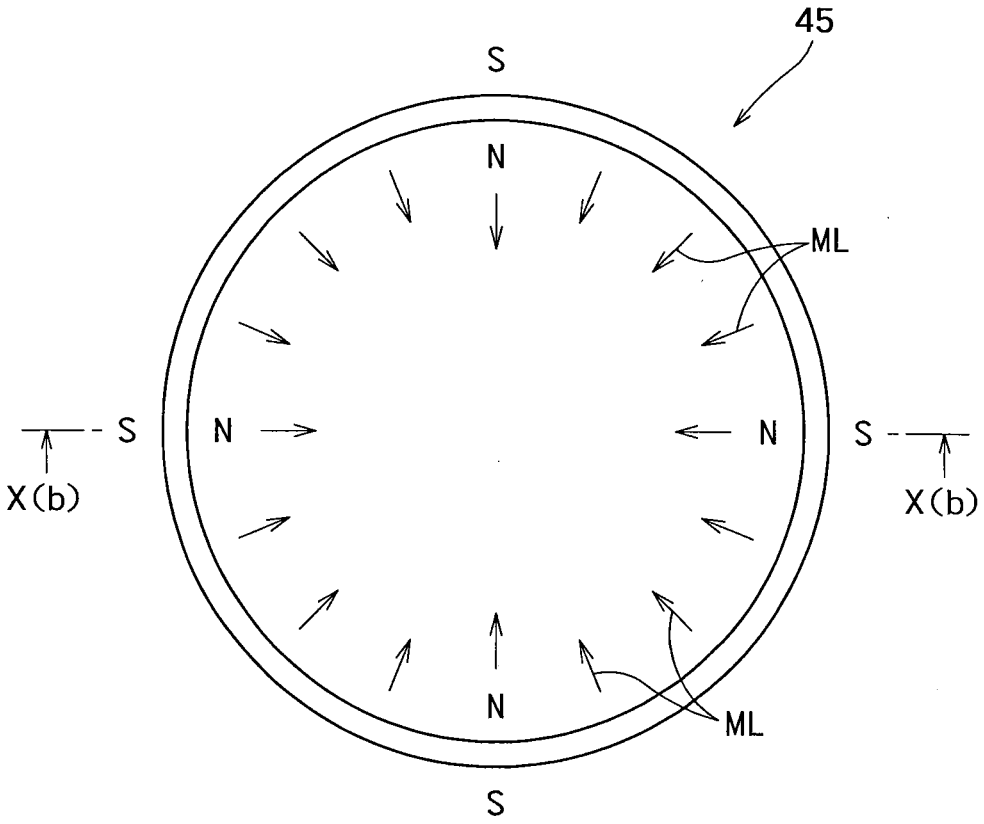
FIG. 10(*a*) is a plan view of a side magnet of another embodiment, and FIG. 10(*b*) is a sectional view taken along line X(b)-X(b) of FIG. 10(*a*).
Figure 10:
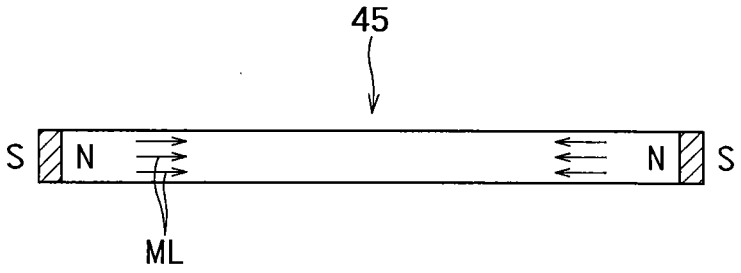

FIG. 9 illustrates another embodiment of the invention. This embodiment is an embodiment in which a side magnet 45 is provided in the water jacket 2*d*. The side magnet 45 is provided so as to be adjustable in the water jacket 2*d* in a vertical direction. The side magnet 45 is illustrated in FIGS. 10(*a*) and 10(*b*). FIG. 10(*a*) is a plan view, and FIG. 10(*b*) is a longitudinal sectional view taken along line X(b)-X(b). As understood from FIGS. 10(*a*) and 10(*b*), the side magnet 45 is formed in a ring shape, the inside of the side magnet 45 is magnetized to a first pole (here, N pole), and the outside of the side magnet 45 is magnetized to a second pole (here, S pole). Alternatively, the inside and outside of the side magnet may be magnetized to the second pole and the first pole, respectively. Accordingly, lines MLs of magnetic force go toward the center. Further, the side magnet 45 may also be formed of a plurality of side magnet pieces having an arc-shaped cross-section.

In the embodiment of FIG. 9, the melt M is rotated and vibrated by the cooperation of the electromagnetic force F that is generated the crossing between the lines ML of magnetic force generated from the upper magnet 4*a* and the current I and an electromagnetic force Fs that is generated by the crossing between the lines MLs of magnetic force generated from the side magnet 45 and the current I.

In this embodiment, as understood from FIG. 9, the lines ML of magnetic force generated from the side magnet 45 also generate an electromagnetic force Fs according to Fleming's rule by crossing the current that flows between the electrodes 5*a* and 5*b*. The electromagnetic force Fs is also a force that stirs and vibrates the melt M.

Figure 11:
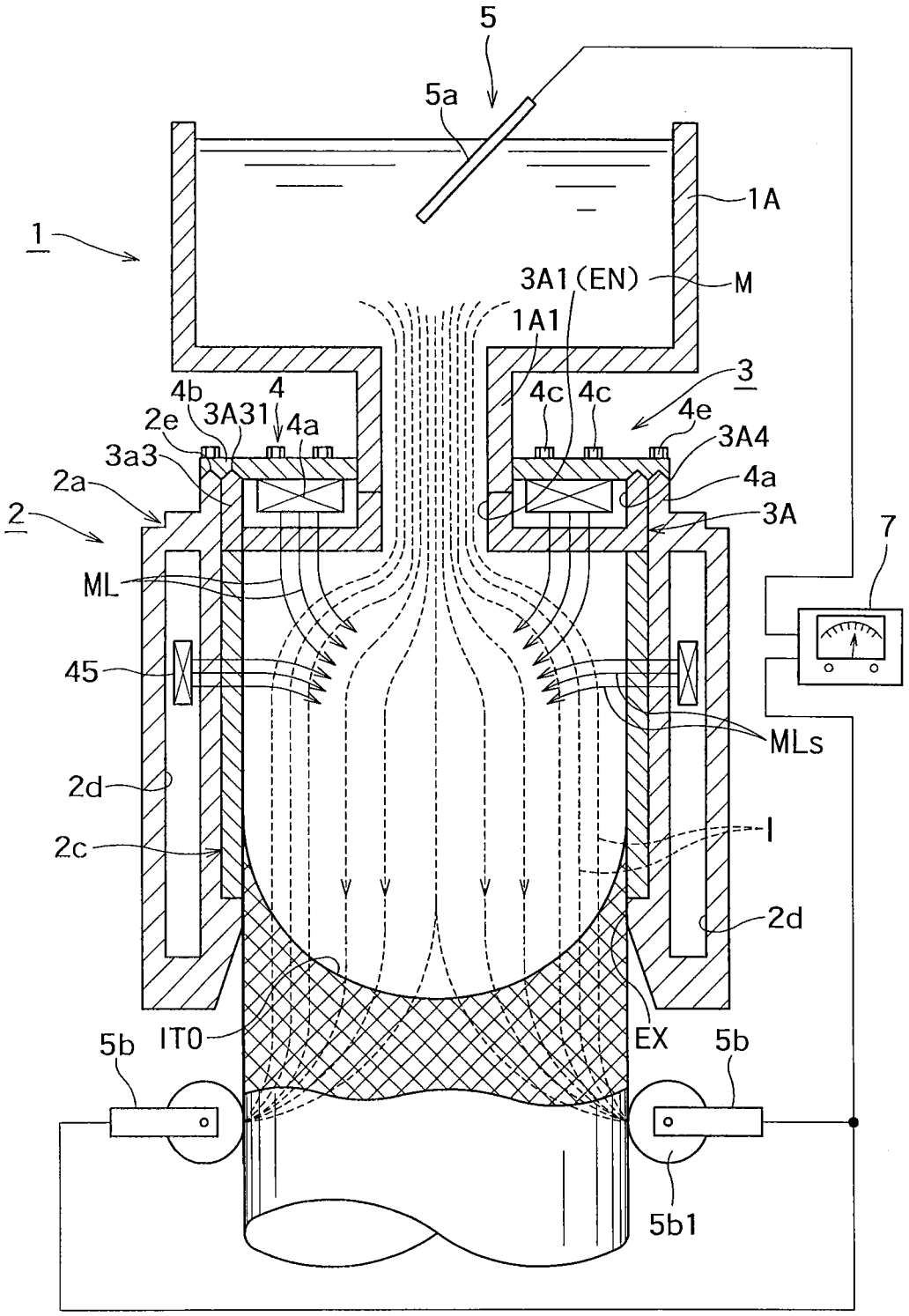
FIG. 11 is a longitudinal sectional view illustrating the entirety of still another embodiment of the invention.

Further, when the side magnet 45 is moved up over the position of FIG. 9 in the water jacket 23 as understood from FIG. 11, the lines MLs of magnetic force generated from the side magnet 45 and the lines ML of magnetic force generated from the upper magnet 4*a* react to (repel) each other. As a result, the directions of the respective lines MLs and ML of magnetic force are changed. That is, when the position of the side magnet 45 is changed in the vertical direction, the directions of the lines ML and MLs of magnetic force of the upper magnet 4*a* and the side magnet 45 can be changed. According to this, when both the upper magnet 4*a* and the side magnet 45 are used as a main magnetic field unit, the melt M can be rotated and vibrated by the cooperation of the respective lines ML and MLs of magnetic force. Furthermore, when the upper magnet 4*a* is used as a main magnetic field unit, the directions of the lines ML of magnetic force of the upper magnet 4*a* may be changed by the lines MLs of magnetic force of the side magnet 45 and the melt M may also be rotated and vibrated by the changed lines ML of magnetic force of the upper magnet 4*a*. When the height of the side magnet 45 is adjusted in the water jacket 23 in the vertical direction in this way in all cases, the melt M can be efficiently rotated and vibrated. That is, neither the lines ML and MLs of magnetic force nor the current I is visually seen, actually. However, when the side magnet 45 is adjusted in the vertical direction, the aspect of the crossing between the lines ML (MLs) of magnetic force and the current I is changed. Accordingly, it is possible to set a state in which the melt M is most vigorously rotated and vibrated.

Meanwhile, the side magnet 45 may also be provided outside the water jacket 23.

According to the above-mentioned embodiments of the invention, the following effects are obtained.

In the embodiments of the invention, the permanent magnet (upper magnet 4*a*) is not provided on the side peripheral surface portion (or in the peripheral wall) of the mold 2 but is provided on the end face portion of the mold 2. As described above, this structure is a structure that is never employed by those skilled in the art. If a product P has a large width (diameter) like a slab when a side magnet is provided on the side peripheral surface portion, a stronger and larger magnet should be used. Further, the cylindrical body 2*c* as a transition ring is generally provided in the inner side of the mold 2. Furthermore, since the mold 2 itself is thick and the cylindrical body 2*c* has a thickness, a distance between the side magnet and the melt M present in the mold is longer. Accordingly, a side magnet that applies a magnetic field having high intensity, that is, a side magnet having a very large size should be used to apply a magnetic field to the melt M by the side magnet. The increase in size should be avoided for various reasons, for example, when multiple products P are produced, that is, when a plurality of devices need to be simultaneously installed. However, since the upper magnet 4*a* is provided on the end face portion of the mold 2 in the embodiments of the invention, a permanent magnet, of which the intensity of a magnetic field is directly proportional to the size (increase in size) of a product P, does not need to be used as the upper magnet 4*a*. The reason for this is that the lines ML of magnetic force can reach the melt M present in the mold from the end face portion of the mold even though the intensity of a magnetic field is not increased to that extent. That is, according to the embodiments of the invention, a large permanent magnet, which has high intensity of a magnetic field directly proportional to the diameter of a product P to be obtained, does not need to be used as a permanent magnet to be used. For this reason, it is possible to make the entire device small.

Further, in the embodiments of the invention, the permanent magnet (upper magnet 4*a*) is not provided in the water jacket 2*d* but is provided on the end face portion of the mold 2. Therefore, there is no limit on the size as the permanent magnet is provided in the water jacket 2*d*, and it is said that flexibility is more excellent when a permanent magnet is employed. Furthermore, since the upper magnet 4*a* is configured to be able to be cooled by the water jacket 2*d*, a function as a magnetic field unit can be secured.

Naturally, in the embodiments of the invention, melt M, which is obtained immediately before being solidified, is stirred so that movement, vibration, or the like is applied to the melt M. Accordingly, a degassing effect or the homogenization and refinement of the structure can also be achieved.

Moreover, since the melt M is stirred by an electromagnetic force according to Fleming's left hand rule in the embodiments of the invention, the melt is stirred by the cooperation of small current that flows in the melt M and a magnetic field that goes out of the upper magnet 4*a*. Accordingly, since a stable, continuous, and reliable stir can be expected unlike a dissolution stir that is performed when large current intermittently flows by an arc welding principle or the like, it is possible to obtain a device that has high continuousness and low noise.

However, the realization of mass production facilities has been required in industries at present. When mass production is considered, it is essential to make a mold as small as possible. Meanwhile, since the device can be made small in the embodiments of the invention, it is possible to construct highly-efficient production facilities for multiple products. That is, an electromagnetic stir in the related art can cope with a case in which several slabs or billets are produced at a time. However, there has been a request on the simultaneous production of more than 100 billets at present. This request cannot be satisfied by the electromagnetic stirring unit in the related art.

However, a permanent magnet is used as a magnetic field generating unit in the device of the invention. For this reason, it is possible to make a stirring unit more compact than an electromagnetic stirring unit in which large current flows. In addition, the permanent magnet is not provided in the lateral direction of the mold but is provided in the longitudinal direction (on the end face portion of the mold). Accordingly, it is possible to make a device small and to sufficiently realize a molding device for mass production facilities.

Further, since the molding device is a permanent magnet type molding device, a unit, which does not generate heat, saves power and energy, and requires low maintenance, can be obtained as a magnetic field generating unit.

Meanwhile, a case in which a billet is obtained as a product has been described above, but it is natural that a device can be adapted to obtain a slab. In this case, it is apparent that components having a circular shape and an annular shape in plain view or a cross-section in the above-mentioned embodiments may have a rectangular shape and a frame shape.

The invention claimed is:

1. A molding device for continuous casting with a stirrer, the molding device from which a solid-phase casting can be taken out by cooling of a melt of a conductive material, the molding device comprising:

a mold that forms a casting by cooling the melt; and the stirrer that applies a magnetic field to the melt present in the mold and allows a current to flow in the melt in this state, wherein the mold includes a cylindrical mold body that is vertically provided, a central portion of the mold body forms a vertical casting space that includes an upper inlet into which the melt flows and a lower outlet from which a product is taken out, a transition plate body, which has a ring shape and functions as a transition plate, is disposed at the inlet of the casting space, the melt is allowed to flow into the casting space from a hole that is formed at a central portion of the transition plate body, and the stirrer includes an upper magnet that includes a permanent magnet body provided above a bottom plate of the transition plate body with the bottom plate interposed therebetween and making lines of magnetic force vertically run into the casting space, and a pair of electrodes that allow the current to flow through the melt when the melt is contained in the casting space, generate an electromagnetic force by making the flowing current cross the lines of magnetic force, and include a first electrode provided at the inlet side and a second electrode provided at the outlet side.

2. The molding device according to claim 1, wherein a water jacket as a space in which cooling water flows is formed in a peripheral wall of the mold body.

3. The molding device according to claim 1, wherein the upper magnet is mounted on a lid body, and the lid body is mounted on the mold body while coming into contact with the mold body so as to transfer heat to the mold body.

4. The molding device according to claim 3, wherein protrusions and recesses for meshing are formed on a contact surface of the lid body and a contact surface of the mold body, which come into contact with each other, respectively, and the lid body and the mold body come into contact with each other while the protrusions and recesses for meshing formed on the contact surfaces mesh each other.

5. The molding device according to claim 4, wherein the protrusions and recesses for meshing, which are formed on the lid body and the mold body, respectively, are formed in an annular shape.

6. The molding device according to claim 3, wherein the lid body and the mold body come into surface contact with each other.

7. The molding device for continuous casting with a stirring according to claim 1, wherein the upper magnet includes a ring plate-shaped yoke body and the permanent magnet body that is mounted on the yoke body.

8. The molding device according to claim 7, wherein the permanent magnet body is mounted on the yoke body so as to be suspended.

9. The molding device for continuous casting with a stirring according to claim 8, wherein the upper magnet includes a cover, and the cover covers the permanent magnet body from below with a gap.

10. The molding device according to claim 1, wherein the permanent magnet body is formed of one ring-shaped permanent magnet or a plurality of permanent magnets that are disposed in an annular shape.

11. The molding device according to claim 1, wherein the permanent magnet body is formed of a plurality of permanent magnets, and each of the permanent magnets is formed of any one of a rectangular body, a columnar body, a conical body, a frustum-shaped body, or a modified fan-shaped body that is formed by cutting off a part of a fan-shaped body.

12. The molding device according to claim 1, wherein the upper magnet is mounted on the mold body so that a gap is formed between the transition plate body and the upper magnet.

13. The molding device according to claim 1, wherein the transition plate body is formed so that a central frame-like wall and a peripheral frame-like wall stand at a central portion and a peripheral portion of the ring-shaped bottom plate, and includes an upper magnet receiving space that is interposed between the central frame-like wall and the peripheral frame-like wall and receives the upper magnet with a gap.

14. The molding device according to claim 1, wherein the first electrode can be installed so as to be electrically conducted to the melt contained in the mold body, and the second electrode can be installed so as to be electrically conducted to a solid-phase product that is taken out from the mold body.

15. The molding device according to claim 1, further comprising:

a side magnet that makes lines of magnetic force laterally run into the casting space of the mold body, wherein a magnetic pole of the side magnet facing the casting space is the same as a magnetic pole of the permanent magnet body of the upper magnet facing the casting space.

* * * * *